US009716946B2

(12) United States Patent
Goshen et al.

(10) Patent No.: US 9,716,946 B2
(45) Date of Patent: Jul. 25, 2017

(54) SYSTEM AND METHOD THEREOF FOR DETERMINING OF AN OPTIMAL DEPLOYMENT OF MICROPHONES TO ACHIEVE OPTIMAL COVERAGE IN A THREE-DIMENSIONAL SPACE

(71) Applicant: InSoundz Ltd., Raanana (IL)

(72) Inventors: Tomer Goshen, Tel Aviv (IL); Emil Winebrand, Petach Tikva (IL)

(73) Assignee: InSoundz Ltd., Ra'anana (IL)

( * ) Notice: Subject to any disclaimer, the term of this patent is extended or adjusted under 35 U.S.C. 154(b) by 33 days.

(21) Appl. No.: 14/727,044

(22) Filed: Jun. 1, 2015

(65) Prior Publication Data

US 2015/0350787 A1 Dec. 3, 2015

Related U.S. Application Data

(60) Provisional application No. 62/006,171, filed on Jun. 1, 2014.

(51) Int. Cl.
*H04R 5/00* (2006.01)
*H04R 5/027* (2006.01)

(52) U.S. Cl.
CPC ..... *H04R 5/027* (2013.01)

(58) Field of Classification Search
CPC ..... H04R 5/027
See application file for complete search history.

(56) References Cited

U.S. PATENT DOCUMENTS

| | | | | |
|---|---|---|---|---|
| 4,741,038 | A | 4/1988 | Elko et al. | |
| 5,335,011 | A | 8/1994 | Addeo et al. | |
| 6,449,593 | B1 | 9/2002 | Valve | |
| 6,707,910 | B1 | 3/2004 | Valve et al. | |
| 6,836,243 | B2 | 12/2004 | Kajala | |
| 7,706,549 | B2 | 4/2010 | Zhang et al. | |
| 7,986,794 | B2 | 7/2011 | Zhang | |
| 2003/0142836 | A1* | 7/2003 | Warren | H04R 25/407 381/92 |
| 2012/0076316 | A1* | 3/2012 | Zhu | H04R 3/005 381/71.11 |
| 2013/0034241 | A1 | 2/2013 | Pandey et al. | |
| 2013/0051577 | A1 | 2/2013 | Morcelli et al. | |
| 2013/0216046 | A1 | 8/2013 | Ikeda et al. | |
| 2014/0029761 | A1 | 1/2014 | Maenpaa et al. | |

* cited by examiner

*Primary Examiner* — Regina N Holder
(74) *Attorney, Agent, or Firm* — M&B IP Analysts, LLC

(57) ABSTRACT

A system and method for determining an optimal arrangement of microphones for coverage of target sound sources are provided. The method includes receiving at least one geometric constraint respective of a three-dimensional microphone space, wherein the microphone space defines a location for possible deployment of a plurality of microphones; receiving information related to the sound sources, wherein sound sources include at least one target sound source; simulating sound distribution patterns from each of the least target sound sources and each microphone in the deployment of the plurality of microphones; selecting based, in part, on the simulated sound distribution patterns at least one contributing microphone from the deployment of the plurality of microphones; and outputting the optimal arrangement to include the least one contributing microphone.

24 Claims, 5 Drawing Sheets

SYSTEM AND METHOD THEREOF FOR DETERMINING OF AN OPTIMAL DEPLOYMENT OF MICROPHONES TO ACHIEVE OPTIMAL COVERAGE IN A THREE-DIMENSIONAL SPACE

CROSS REFERENCE TO RELATED APPLICATIONS

This application claims the benefit of U.S. Provisional Patent Application No. 62/006,171 filed on Jun. 1, 2014, the contents of which are incorporated herein by reference.

TECHNICAL FIELD

The disclosure generally relates to sound capturing systems and, more specifically, to placement of microphones within a defined space of the sound capturing system.

BACKGROUND

The capturing of remote sounds may be beneficial in many applications ranging from inelegance to entertainment. For example, many users find the audio experience to be highly important when a broadcast TV show includes multiple sub-events occurring concurrently. As another example, for security purposes and surveillance there is a common need to optimally collect audio signals within certain spaces for a variety of reasons.

One challenge with fulfilling such a requirement is that currently used sound capturing devices, i.e., microphones, are unable to practically adjust to the dynamic and intensive environment of complex audio events, for example, a sporting event. In fact, currently used microphones are barely capable of tracking a single player or coach as that person runs or otherwise moves. Commonly, a large microphone boom is used to move the microphone around in an attempt to capture the sound. This issue is becoming significantly more notable due to the advent of high-definition (HD) television that provides high-quality images on the screen with disproportionately low sound quality.

One challenge in remote capturing of sounds is the determination of the optimal placement of microphones to achieve optimal coverage. For example, to capture a conversation between two people in a noisy restaurant, the optimal placement of the microphones is key to clearly capturing the sound.

The determination of the location and amount of the microphones in order to achieve optimal coverage is a complicated task as it is subject to the geometric constraints of the target space. Furthermore, within the target space there is a need to differentiate between relevant and irrelevant sound sources. As in the above example, the restaurant is a large room with many tables and people and the exact location where the conversation of interest takes place is unknown. Thus, there are many possible combinations to deploy the microphones in such a room. This problem is even more complicated in large venues, such as a bus, train or airport terminals, streets, and or sport arenas.

It would therefore be advantageous to provide a solution for determination of a microphone arrangement to achieve optimal sound collection coverage in a three-dimensional space.

SUMMARY

A summary of several example embodiments of the disclosure follows. This summary is provided for the convenience of the reader to provide a basic understanding of such embodiments and does not wholly define the breadth of the disclosure. This summary is not an extensive overview of all contemplated embodiments, and is intended to neither identify key or critical elements of all embodiments nor to delineate the scope of any or all aspects. Its sole purpose is to present some concepts of one or more embodiments in a simplified form as a prelude to the more detailed description that is presented later. For convenience, the term "some embodiments" may be used herein to refer to a single embodiment or multiple embodiments of the disclosure.

Certain embodiments disclosed herein include a method for determining an optimal arrangement of microphones for coverage of target sound sources. The method includes receiving at least one geometric constraint respective of a three-dimensional microphone space, wherein the microphone space defines a location for possible deployment of a plurality of microphones; receiving information related to the sound sources, wherein sound sources include at least one target sound source; simulating sound distribution patterns from each of the least target sound sources and each microphone in the deployment of the plurality of microphones; selecting based, in part, on the simulated sound distribution patterns at least one contributing microphone from the deployment of the plurality of microphones; and outputting the optimal arrangement to include the least one contributing microphone.

Certain embodiments disclosed herein also include a system for determining an optimal arrangement of microphones for coverage of target sound sources. The system includes an input/output (I/O) interface configured to receive at least one geometric constraint respective of a three-dimensional microphone space, wherein the microphone space defines a location for possible deployment of a plurality of microphones, the output (I/O) interface is configured to receive information related to the sound sources, wherein sound sources include at least one target sound source; a sound distribution pattern simulator (SDPS) configured to simulate sound distribution patterns from each of the least target sound source and each microphone in the deployment of the plurality of microphones; and a microphones arrangement generator (MAG) configured to select based, in part, on the simulated sound distribution patterns at least one contributing microphone from the deployment of the plurality of microphones, the MAG is further configured to output the optimal arrangement to include the at least one contributing microphone.

Certain embodiments disclosed herein include a system for determining an optimal arrangement of microphones for coverage of target sound sources. The system includes a processing unit; and a memory, the memory containing instructions that, when executed by the processing unit, configure the system to: receive at least one geometric constraint respective of a three-dimensional microphone space, wherein the microphone space defines a location for possible deployment of a plurality of microphones; receive information related to the sound sources, wherein the sound sources include at least one target sound source; simulate sound distribution patterns from each of the least target sound source and each microphone in the deployment of the plurality of microphones; select based, in part, on the simulated sound distribution patterns at least one contributing microphone from the deployment of the plurality of microphones; and output the optimal arrangement to include the at least one contributing microphone.

BRIEF DESCRIPTION OF THE DRAWINGS

The subject matter that disclosed herein is particularly pointed out and distinctly claimed in the claims at the conclusion of the specification. The foregoing and other objects, features and advantages of the invention will be apparent from the following detailed description taken in conjunction with the accompanying drawings.

DETAILED DESCRIPTION

Figure 1:
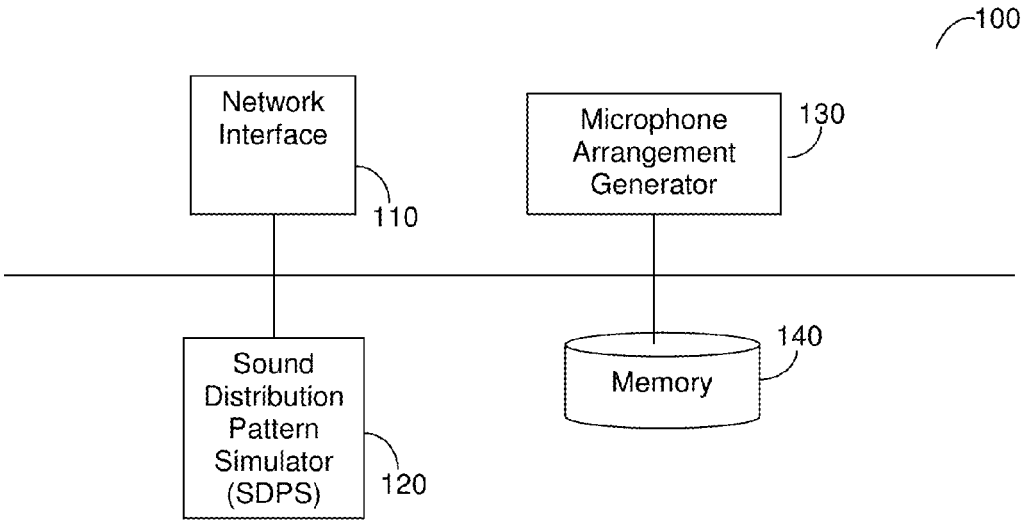
FIG. 1 is a block diagram of a system for determining an optimal arrangement of microphones in a three-dimensional target space according to an embodiment.

It is important to note that the embodiments disclosed herein are only examples of the many advantageous uses of the innovative teachings herein. In general, statements made in the specification of the present application do not necessarily limit any of the various claims. Moreover, some statements may apply to some inventive features but not to others. In general, unless otherwise indicated, singular elements may be in plural and vice versa with no loss of generality. In the drawings, like numerals refer to like parts through several views.

According to some exemplary embodiments, the disclosed system is configured to receive geometric constraints of a three-dimensional microphone space and a position of target sound sources associated with a target space. In response, the disclosed system is configured to simulate, based on the geometric constraints, sound and noise distribution patterns from target and non-target sound sources respectively. Respective of the sound distribution patterns and the noise distribution patterns, the system is configured to determine and output an optimal arrangement of a plurality of microphones to be utilized for capturing sounds produced by the target sound sources. The microphone arrangement includes a definition of coordinates of each of the plurality of microphones within the microphone space. The various embodiments of the disclosed system will be discussed in more detail below.

FIG. 1 is an exemplary and non-limiting schematic illustration of a system 100 implemented according to one embodiment. The system 100 includes at least one interface 110 for receiving configuration data. Optionally, the interface 110 may be an interface to a network or to any other input/output mean, such as a keyboard, a mouse, a touch screen, and the like. The network (not shown) may be, but is not limited to, a local area network (LAN), a wide area network (WAN), a metro area network (MAN), the world wide web (WWW), the Internet, a wired network, a wireless network, and the like.

According to one embodiment, the interface 110 is configured to receive geometric constraints respective of a three-dimensional microphone space. The three-dimensional microphone space may be, for example, a designated location within a room, a hall, a venue, and any other type of closed or open space. The geometric constraints may be in a form of a geometric contour of the three-dimensional microphone space, geometric information related to the surface of the three-dimensional microphone space, geometric information related to the boundaries of the three-dimensional microphone space, sound blocking elements located within or nearby the three-dimensional microphone space, sound reflecting elements located within or nearby the three-dimensional microphone space, a combination thereof, and so on.

The interface 110 is further configured to receive information related to sound sources. A sound source may be a target or noise. A target sound source is any type of entity generating sounds which a user of the system wishes to track, for example, a human, a group of humans, and so on. A noise sound source is not a target sound source, thereby interrupting the coverage of the sounds generated by the target sources. For example, a target sound source may be a person and noise sound source may be a nearby speaker.

The received information may include a location in space of each of the sound sources, a desired, estimated, or actual distance of each sound source from the microphone space, a frequency range of each sound source, and so on.

The system 100 further includes a sound distribution pattern simulator (SDPS) 120. The SDPS 120 is configured to simulate sound distribution patterns from each of the sound sources and noise distribution patterns. The sound distribution patterns reflect the designated coverage areas. The noise distribution patterns may include sound signals produced by "noise" sound sources. It should be noted that the simulated noise distribution patterns and sound distribution patterns can be fully overlapped, partially overlapped, or not overlapped at all.

In an embodiment, the SDSP 120 simulates a sound or noise distribution pattern as a prorogation of an audio signal generated by a sound source (target or noise) through an acoustic channel between the source and a microphone in the microphone space. In an exemplary embodiment, the simulation is performed respective of the distance between the sound source and the microphone as follows:

$$h(i, j) = \frac{e^{-i\omega t\rho(i,j)/c}}{\rho(i, j)}$$

where, h(i, j) is an acoustic channel from a sound source 'i' to a microphone 'j', ρ(i, j) is the distance between a sound source 'i' to a microphone 'j', 'ω' is the phase, and 'c' is the speed of sound. As noted above, a sound source may be either a target or noise source. It should be noted that the above equation assumes a line of sight between sound source 'i' to a microphone 'j'.

To perform the simulation, a dense grid of candidate microphones is "virtually" deployed in the microphone space by setting their respective 3D coordinates. The simulation is performed for each such candidate microphone and a sound source.

As shown in FIG. 1, the system 100 also includes a microphones arrangement generator (MAG) 130. The MAG 130 is configured to determine the optimal arrangement of microphones respective of the noise distribution patterns and the sound distribution patterns. The optimal arrangement of microphones includes the most "contributing" microphones selected through a ranking process. Then, the MAG 130 outputs the optimal microphones arrangement within the determined space. The determined microphones arrangement may be output to the user through an I/O interface (not shown). The operation of the MAG 130 is described in further detail with respect to FIG. 5.

According to another embodiment, the system 100 may also include a memory 140 for storing the various received constraints, the determined microphones arrangement, and instructions for operating at least the NDPS 120 and the MAG 130. The memory 140 may be, but is not limited to, a volatile memory such as random access memory (RAM), or a non-volatile memory (NVM), such as Flash memory.

In an embodiment, the modules of the system 100, such as the NDPS 120 and MAG 130, may be realized by a processing system. The processing system may comprise or be a component of a larger processing system implemented with one or more processors. The one or more processors may be implemented with any combination of general-purpose microprocessors, microcontrollers, digital signal processors (DSPs), field programmable gate array (FPGAs), programmable logic devices (PLDs), controllers, state machines, gated logic, discrete hardware components, dedicated hardware finite state machines, or any other suitable entities that can perform calculations or other manipulations of information.

The processing system may also include machine-readable media for storing software. Software shall be construed broadly to mean any type of instructions, whether referred to as software, firmware, middleware, microcode, hardware description language, or otherwise. Instructions may include code (e.g., in source code format, binary code format, executable code format, or any other suitable format of code). The instructions, when executed by the one or more processors, cause the processing system to perform the various functions described herein.

Figure 2:
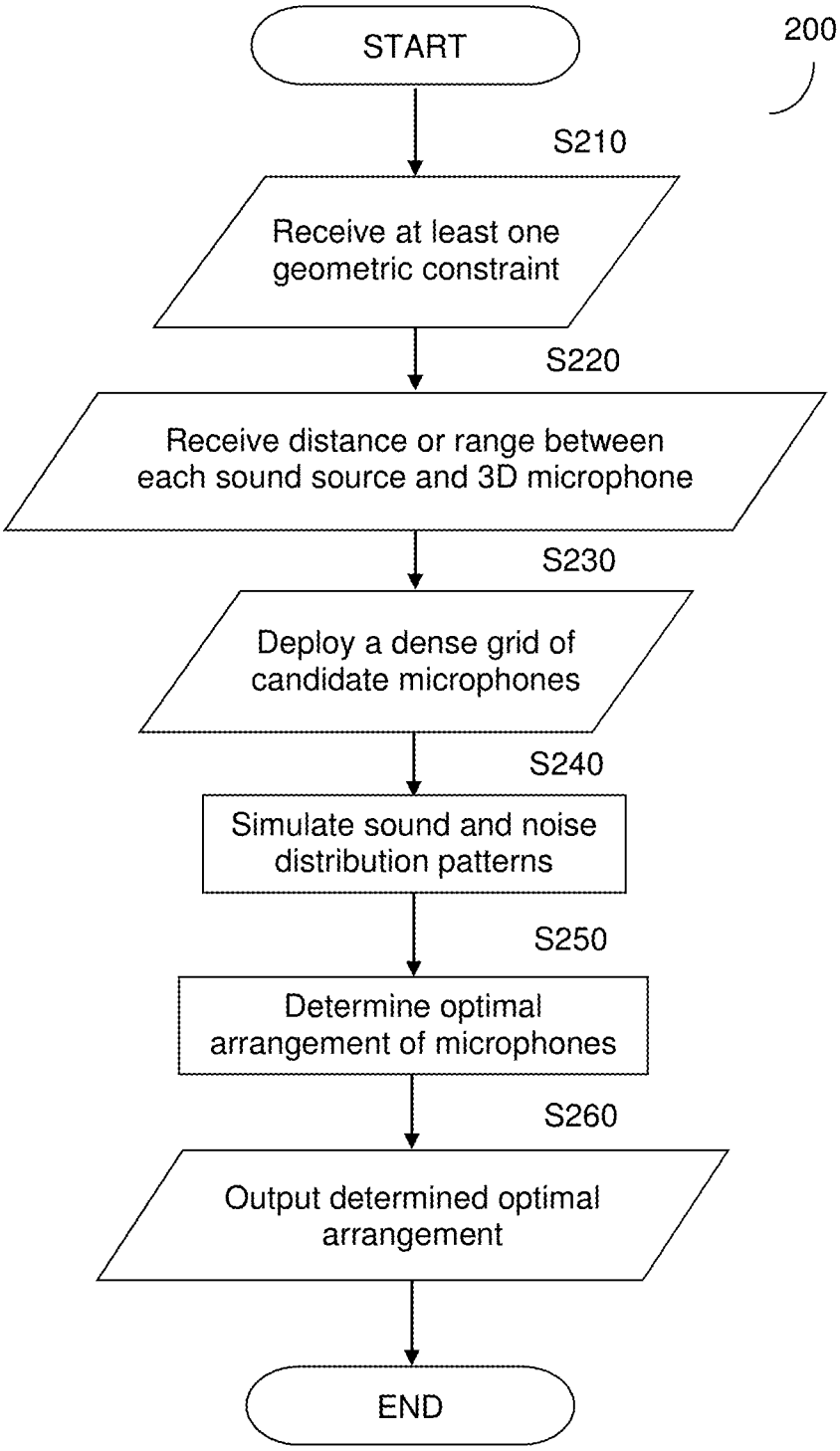
FIG. 2 is a flowchart describing a method for generating optimal arrangement of microphones in a three-dimensional target space according to an embodiment.

FIG. 2 is an exemplary and non-limiting flowchart 200 describing a method of determining an optimal placement of microphones in a three-dimensional space according to one embodiment. The method may be performed by the system discussed with respect to FIG. 1.

In S210, at least one geometric constraint of a three-dimensional microphone space is received. The microphone space defines where microphones can be deployed. Examples for geometric constraints are provided above. In S220, a distance or a range between each sound source and the three-dimensional microphone space is also received. In an embodiment, S220 includes also receiving the number of sound sources, their type (target or noise), and specific location (e.g., determine by a set of 3D coordinates). An illustrative example for the microphone space and the sound source is provided in FIG. 3.

In S230, a dense grid of candidate microphones is deployed within the three-dimensional microphone space. The deployment may include setting the three-dimensional coordinates of each candidate microphone within the microphone space.

In S240, sound and noise distribution patterns are simulated. Specifically, in an embodiment, the acoustic channel between each sound source and each candidate microphone is simulated. It should be noted that the identification of noises generated by sources which are not the target sources is necessary in order to isolate the noises generated by the target sources. As an example, in case a specific conversation in a restaurant is to be monitored by the microphones, thus considered a target sound source, other sound sources, e.g., other conversations and background noises, are considered as noise sound sources and are to be eliminated. In an embodiment, the simulation of the sound distribution patterns is performed by the SDPS 120 (see FIG. 1), across a predefined frequency range. The frequency range may be a frequency range of typical voiced speech.

In S250, based on simulated sound distribution patterns and noise distribution patterns, an optimal arrangement of microphones is determined. In an embodiment, the determination is realized through a ranking process where a predefined number of most contributing microphones are selected. An embodiment of the ranking process is described in more detail in FIG. 5.

In S260, the determined optimal arrangement of the microphones is output. The determined optimal arrangement defines at least coordinates of each of the plurality microphones within the arrangement. Thus, the disclosed method and system provide a plane for deployment of the microphones in the three-dimensional microphone space to allow clear capturing of the sound signals voice by the target sources.

Figure 3:
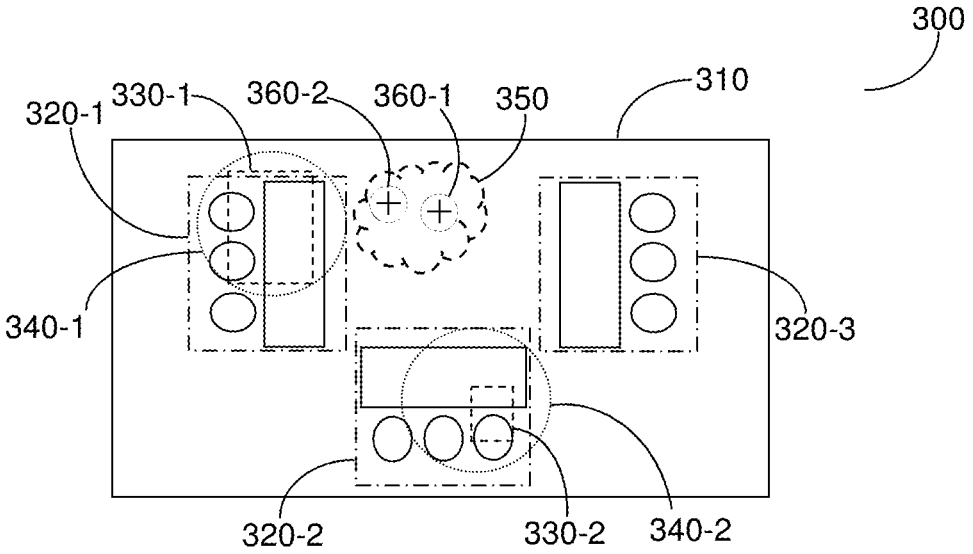
FIG. 3 is a simulation of sound distribution patterns generated respective of sound sources in a three-dimensional target space according to an embodiment.

FIG. 3 is an exemplary and non-limiting diagram 300 illustrating a deployment of microphones within a three-dimensional microphone space relative to the sound sources.

An exemplary three-dimensional target space 310 is a room (e.g., a conference room) having a rectangular shape. In the space 310, sets of a table and three chairs, 320-1, 320-2, and 320-3 are set. The shape of the room (the space 310) together with the objects (tables 320) function as geometric constraints to the microphone space. Other constraints define where not to set the microphones, i.e. under the tables 320. The potential target sound sources are labeled as 330-1 and 330-2 in FIG. 3. The geometric constraints form a three-dimensional microphone space 350 in which the microphones arrangement can be deployed.

According to the disclosed embodiment, the SDPS 120 simulates sound distribution patterns 340-1 and 340-2 (shown as dashed-circles) from the two target sources 330-1 and 330-2 respectively. In addition, using the simulated sound distribution patterns 340-1 and 340-2, the MAG 130 determines the location of each the microphones 360-1 and 360-2 within the microphone space 350.

Figure 4:
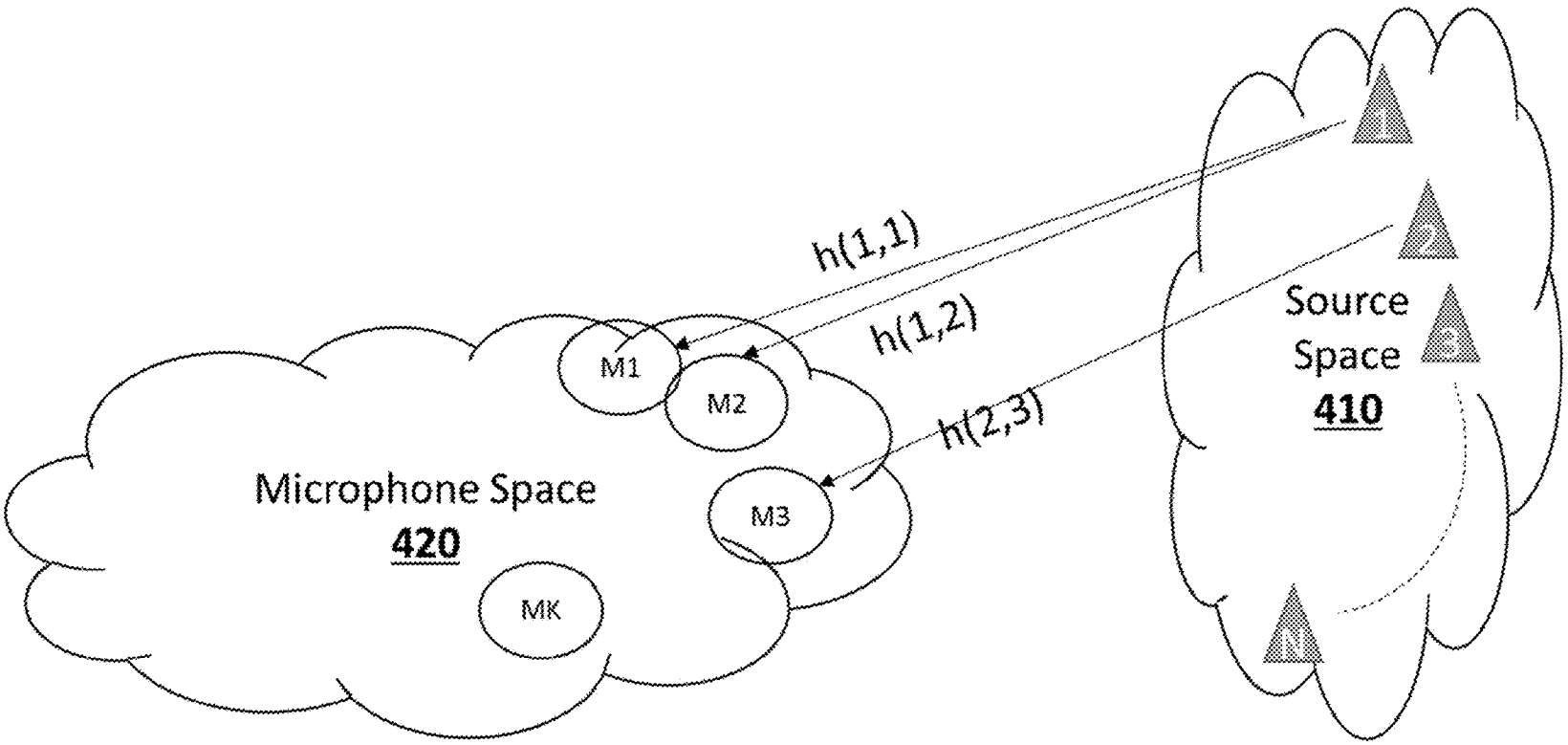
FIG. 4 is a schematic diagram depicting the simulation of sound distribution patterns in accordance with an embodiment.

FIG. 4 is an exemplary and non-limiting schematic diagram 400 depicting the simulation of sound distribution patterns according to an embodiment. As noted above, in order to simulate sound distribution patterns, the SDPS 120 requires at least a geometric constraint respective of a three-dimensional microphone space 420 and a position of sound sources $S_1$ through $S_n$ located in a predefined area or space 410. Each of the sound sources $S_1$ through $S_n$ may be a target or a noise source as discussed above. In the example shown in FIG. 4, the array of microphones $M_1$ through $M_K$ is deployed in the microphone space 420.

As illustrated in FIG. 1, the simulation of the sound patterns is based on the acoustic channel h(i,j) between a source $S_i$ and a microphone $M_J$ in the microphone space 420. In an embodiment, based on the sound patterns the most contributing microphones out of the array of microphones $M_1$ and $M_K$ are selected to be part of the optimal arrangement of microphones. In the exemplary FIG. 4, microphones $M_1$ and $M_2$ are selected. An embodiment for selection of the most contributing microphones is explained below with respect to FIG. 5.

Figure 5:
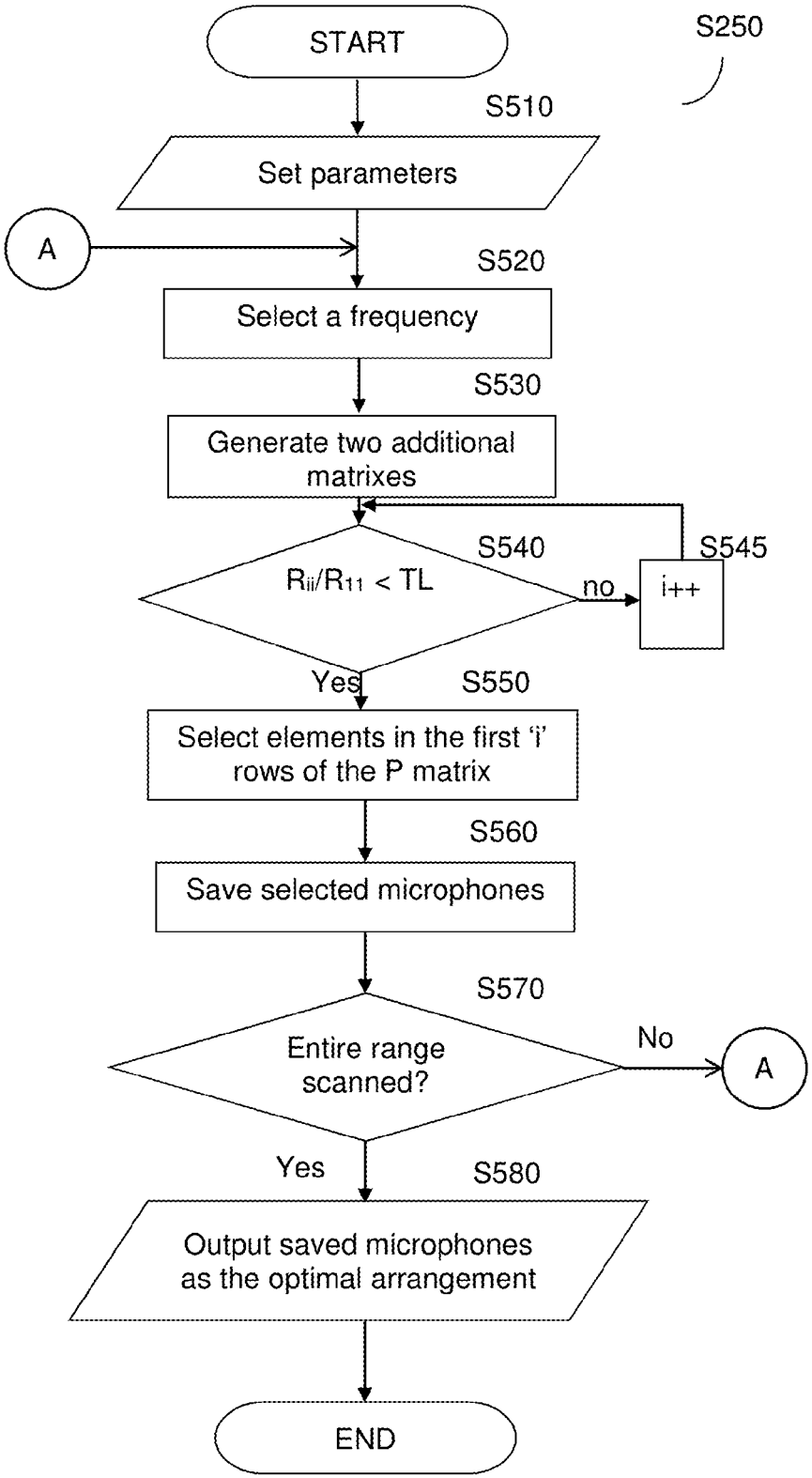
FIG. 5 is a flowchart describing a ranking process for determining the optimal arrangement of microphones according to one embodiment.

FIG. 5 shows an exemplary and non-limiting flowchart S250 describing a ranking process for determining the optimal arrangement of microphones according to one embodiment. The method may be performed by the MAG 130.

In S510, a few parameters including a frequency range of the sound source and at least one optimal condition are set. An optimal condition may be, for example, an accepted tolerance (TL) for a microphone contribution and/or a number of desired microphones in the arraignment. The accepted tolerance may be set to a certain decibel (dB) value. The frequency range may be set as a typical voiced speech.

In S520, a frequency ($f_x$), which may be a discrete frequency or a sub-range out of the frequency range, is selected. In S520, a decomposed matrix A is computed per selected frequency ($f_x$). In one embodiment, the decomposed matrix A is a N by M (N×M) matrix including the acoustic channels (or sound patterns) between the sources and microphones. According to this embodiment, the A matrix is computed is follows:

$$A = \begin{pmatrix} h(1,1) & \dots & h(1,M) \\ \vdots & \ddots & \vdots \\ h(N,1) & \dots & h(N,K) \end{pmatrix}$$

The equation for computing h(i,j) is provided above.

In another embodiment, the decomposed matrix A may be the noise covariance matrix N, with dimension of N by K. In yet another embodiment, the decomposed matrix A is a weighted matrix, where each column is the vector of a beamforming weighting factor for each desired source. In this embodiment, the matrix dimension is K×N (K is the number of microphones and N is the number of sources).

In S530, two additional matrixes R and P are computed. The R matrix is a triangular matrix and P matrix is a permutation matrix chosen so that the diagonal elements of the R matrix are non-increasing. Furthermore, R and P matrixes are computed to meet the following condition:

$$A = Q \cdot R \cdot P^T$$

Thereafter, the most contributing microphones for the frequency $f_x$ are selected. In an embodiment, the selection is performed based on the diagonal elements of the R matrix. Specifically, in S540, for each i=1, . . . , K (K is the number of microphones), it is checked if the optimal condition is met. If the optimal condition is met, execution continues with S550; otherwise, at S545, the 'i' is incremented by 1 and execution returns to S540. In an embodiment the optimal condition is defined as follows:

$$\frac{R_{ii}}{R_{11}} < TL$$

As noted above, the diagonal elements $R_{ii}$ of the R matrix are arranged in a non-decreasing order, thus $R_{11}$ has the largest value. TL is the predefined optimal condition, which in this case is the accepted tolerance. In another embodiment, the constraint may be the number of required microphones. In such a case, the condition's value is compared to the value 'i'. In S550, the elements in the first 'i' rows of the P matrix are selected. These elements represent the most contributing microphones in the frequency $f_x$.

It should be noted that the diagonal elements of the R matrix are the upper bound of the singular values and indicate the rank of the matrix according to the optimal condition. This defines the number of required microphones in the optimal arraignment, and the elements of the P matrix indicate the microphones ($M_1$, $M_K$) that should be selected.

In S560, the selected microphones are saved, for example in a memory of the system 110. In S570, it is checked if the entire input frequency range has been scanned; if so execution continues with S580 were the selected microphones saved in S560 are output as the optimal arrangement of microphones; otherwise, execution returns to S520 where a new value of $f_x$ is selected.

The ranking process discussed in FIG. 5 is based on the decomposed matrix A. Other techniques for selecting the microphones that meet at least one optimal condition may be utilized. Examples for such techniques include at least a linear programming and a Nyquist spatial search.

The embodiments disclosed herein are not limited to the optimal placement of microphones in a three-dimensional space. The disclosed embodiments can be utilized to determine the other electronic means to achieve optimal cover of space. For example, such electronic means include infrared sensors, antennas, radio frequency (RF) sensors, hydroponic sensors, and so on.

The embodiments disclosed herein can be implemented as hardware, firmware, software or any combination thereof. Moreover, the software is preferably implemented as an application program tangibly embodied on a program storage unit or computer readable medium. The application program may be uploaded to, and executed by, a machine comprising any suitable architecture. Preferably, the machine is implemented on a computer platform having hardware such as a processing unit ("CPU"), a memory, and input/output interfaces. The computer platform may also include an operating system and microinstruction code. The various processes and functions described herein may be either part of the microinstruction code or part of the application program, or any combination thereof, which may be executed by a CPU, whether or not such computer or processor is explicitly shown. In addition, various other peripheral units may be connected to the computer platform such as an additional data storage unit and a printing unit and/or display unit.

All examples and conditional language recited herein are intended for pedagogical purposes to aid the reader in understanding the principles of the invention and the concepts contributed by the inventor to furthering the art, and are to be construed as being without limitation to such specifically recited examples and conditions. Moreover, all statements herein reciting principles, aspects, and embodiments of the invention, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

What is claimed is:

1. A method for determining an optimal arrangement of microphones for coverage of target sound sources, comprising:

receiving at least one geometric constraint of a three-dimensional microphone space, wherein the microphone space defines a location for possible deployment of a plurality of microphones;

receiving information related to sound sources, wherein the sound sources include at least one target sound source;

simulating sound distribution patterns from each of the at least one target sound sources source and each microphone in the deployment of the plurality of microphones determined based on the respective three-dimensional microphone space;

selecting based, in part, on the simulated sound distribution patterns at least one contributing microphone from the deployment of the plurality of microphones; and outputting the optimal arrangement to include the least one contributing microphone.

2. The method of claim 1, wherein the optimal arrangement includes deployment coordinates of each of the at least one contributing microphones within the three-dimensional microphone space.

3. The method of claim 1, wherein the at least one geometric constraint is at least one of: a geometric contour of the three-dimensional microphone space, geometric information related to a surface of the three-dimensional microphone space, geometric information related to boundaries of three-dimensional microphone space, sound blocking elements located within or nearby the three-dimensional microphone space, and sound reflecting elements located within or nearby the three-dimensional microphone space.

4. The method of claim 1, wherein information related to the sound sources includes at least one of: a location of the sound sources; a desired, estimated, or actual distance of the sound source from the three-dimensional microphone space, and a frequency range of the sound source.

5. The method of claim 1, wherein the sound sources further include at least one noise sound source, wherein the at least noise interrupts for covering sounds generated by the at least one target source.

6. The method of claim 5, wherein simulating sound distribution patterns further comprises:

simulating, across a frequency range, target sound distribution patterns for the at least one target sound source; and simulating, across a frequency range, noise sound distribution patterns for the at least one noise sound source.

7. The method of claim 1, wherein simulating sound distribution patterns further comprises:

simulating, across a frequency range, an acoustic channel from each of the least target sound source and each microphone in the deployment of the plurality of microphones, wherein the frequency range is a fundamental frequency of the least target sound source.

8. The method of claim 1, wherein selecting at least one contributing microphone further comprises:

selecting one or more microphones from the possible deployment of the plurality of microphones that meet at least one predefined optimal condition, wherein the at least one predefined optimal condition is any one of: an acceptable tolerance and a maximum number of microphones.

9. The method of claim 8, wherein selecting the at least one contributing microphone to meet the acceptable tolerance further comprises:

selecting each microphone participating in an acoustic channel yielding a value above the acceptable tolerance to be a contributing microphone.

10. The method of claim 8, wherein selecting the at least one contributing microphone to meet the maximum number of microphones further comprises:

selecting a first maximum number of microphones respective of their acoustic channel values, thereby the optimal arrangement further includes an optimal number of microphones.

11. The method of claim 1, wherein a microphone in the optimal arrangement is a sensor.

12. A non-transitory computer readable medium having stored thereon instructions for causing one or more processing units to execute the method according to claim 1.

13. A system for determining an optimal arrangement of microphones for coverage of target sound sources, comprising:

an input/output (I/O) interface configured to receive at least one geometric constraint of a three-dimensional microphone space, wherein the microphone space defines a location for possible deployment of a plurality of microphones, the output (I/O) interface is configured to receive information related to sound sources, wherein the sound sources include at least one target sound source;

a sound distribution pattern simulator (SDPS) configured to simulate sound distribution patterns from each of the at least one target sound source and each microphone in the deployment of the plurality of microphones determined based on the respective three-dimensional microphone space; and a microphones arrangement generator (MAG) configured to select based, in part, on the simulated sound distribution patterns at least one contributing microphone from the deployment of the plurality of microphones, the MAG is further configured to output the optimal arrangement to include the at least one contributing microphone.

14. A system for determining an optimal arrangement of microphones for coverage of target sound sources, comprising:

a processing circuitry; and a memory, the memory containing instructions that, when executed by the processing circuitry, configure the system to:

receive at least one geometric constraint of a three-dimensional microphone space, wherein the microphone space defines a location for possible deployment of a plurality of microphones;

receive information related to sound sources, wherein the sound sources include at least one target sound source;

simulate sound distribution patterns from each of the at least one target sound source and each microphone in the deployment of the plurality of microphones determined based on the respective three-dimensional microphone space;

select based, in part, on the simulated sound distribution patterns at least one contributing microphone from the deployment of the plurality of microphones; and output the optimal arrangement to include the at least one contributing microphone.

15. The system of claim 14, wherein the optimal arrangement includes deployment coordinates of each of the at least one contributing microphones within the three-dimensional microphone space.

16. The system of claim 14, wherein the at least one geometric constraint is at least one of: a geometric contour of the three-dimensional microphone space, geometric information related to a surface of the three-dimensional microphone space, geometric information related to boundaries of three-dimensional microphone space, sound blocking elements located within or nearby the three-dimensional microphone space, and sound reflecting elements located within or nearby the three-dimensional microphone space.

17. The system of claim 14, wherein information related to the sound sources includes at least one of: a location of the sound sources; a desired, estimated, or actual distance of the sound source from the three-dimensional microphone space, and a frequency range of the sound source.

18. The system of claim 14, wherein the sound sources further include at least one noise sound source, wherein the at least noise interrupts for covering sounds generated by the at least one target source.

19. The system of claim 18, wherein the system is further configured to:

simulate, across a frequency range, target sound distribution patterns for the at least one target sound source; and simulate, across a frequency range, noise sound distribution patterns for the at least one noise sound source.

20. The system of claim 14, wherein the system is further configured to:

simulate, across a frequency range, an acoustic channel from each of the least target sound source and each microphone in the deployment of the plurality of microphones, wherein the frequency range is a fundamental frequency of the least target sound source.

21. The system of claim 14, wherein the system is further configured to: select one or more microphones from the possible deployment of the plurality of microphones that meet at least one predefined optimal condition, wherein the at least one predefined optimal condition is any one of: an acceptable tolerance and a maximum number of microphones.

22. The system of claim 21, wherein the system is further configured to:

select each microphone participating in an acoustic channel yielding a value above the acceptable tolerance to be a contributing microphone.

23. The system of claim 21, wherein the system is further configured to select a first maximum number of microphones respective of their acoustic channel values, thereby the optimal arrangement further includes an optimal number of microphones.

24. The system of claim 14, wherein a microphone in the optimal arrangement is a sensor.

* * * * *